US005678770A

United States Patent [19]

Shah

[11] Patent Number: 5,678,770

[45] Date of Patent: Oct. 21, 1997

[54] POWDER COATING SPRAY GUN WITH RESETTABLE VOLTAGE MULTIPLIER

[76] Inventor: Amal B. Shah, 3-B Green Acres 101, Lokhandwala Complex,, Andheri (W), Bombay - 400058, India

[21] Appl. No.: 611,765

[22] Filed: Mar. 8, 1996

[51] Int. Cl.[6] ..... B05B 5/00

[52] U.S. Cl. ..... 239/690; 361/227; 361/228

[58] Field of Search ..... 239/690, 697, 239/698, 708, 526; 361/226, 227, 228

[56] References Cited

U.S. PATENT DOCUMENTS

| | | | |
|---|---|---|---|
| 3,056,557 | 10/1962 | Walberg . | |
| 3,382,091 | 5/1968 | Drum . | |
| 3,608,823 | 9/1971 | Buschor . | |
| 4,066,041 | 1/1978 | Buschor et al. . | |
| 4,196,465 | 4/1980 | Buschor | 361/228 |
| 4,548,363 | 10/1985 | McDonough | 361/227 X |
| 5,056,720 | 10/1991 | Crum et al. | 239/708 X |
| 5,503,880 | 4/1996 | Matschke | 239/708 X |

*Primary Examiner*—Andres Kashnikow
*Assistant Examiner*—Robin O. Evans
*Attorney, Agent, or Firm*—Barry R. Lipsitz; Ralph F. Hoppin

[57] ABSTRACT

A powder coating spray gun includes a high voltage generator with a transformer and voltage multiplier circuitry located within the handle and barrel portions of the gun. The voltage multiplier circuitry includes a number of stages of capacitors and diodes. In the event of failure of the voltage multiplier, backup or secondary circuitry may be selected by the user by removing the barrel of the spray gun from the handle, rotating the barrel to a second position, and re-inserting the barrel into the handle. The secondary circuitry can include a duplicate capacitor for the first stage of the voltage multiplier. A first and second set of connecting pins in the barrel of the spray gun couple the voltage multiplier circuitry with the transformer. The connecting pins are received at active sockets and inactive openings in the handle portion of the spray gun.

20 Claims, 4 Drawing Sheets

100
20
75
C1B
C2A
C2B
C1A
80
210
218
212
50
220
214
216
30
58
54
260
4b
4c

POWDER COATING SPRAY GUN WITH RESETTABLE VOLTAGE MULTIPLIER

BACKGROUND OF THE INVENTION

The present application claims the benefit of US Provisional application no. 60/009566 filed Jan. 3, 1996.

This invention relates to circuitry for a powder coating apparatus, and more particularly to an improved powder coating spray gun with an electrostatic voltage generator circuit which can be easily reset in the event of a circuit failure.

Manufactured objects are commonly coated by spraying an electrically charged powder onto the object while the object is electrically grounded. Electrostatic attraction holds the powder on the object until heat is applied to flow the powder together and to cure it. An apparatus for electrostatic powder coating is typically comprised of an electrostatic voltage generator, a container for holding and suspending powder in a fluid such as air, a jet pump for conveying fluidized powder, and a spray gun. Using additional fluid, the jet pump induces a stream of fluidized powder from the container and propels the fluidized powder through a hose leading to the spray gun. The powder particles are electrically charged via electrodes at the nozzle of the gun and sprayed onto the object to be coated.

In particular, the electrostatic voltage generator includes a high-voltage direct current multiplier connected to the charging electrodes. In many applications, the high voltage generator is an all solid-state unit located within the gun. This eliminates the stiff, cumbersome high-voltage cable that is required when the voltage generator is remote from the gun. Such a cable is prone to fatigue fracture after repeated flexing, particularly in high-volume robotic applications. Alternatively, the high-voltage generator may be located remotely from the spraying gun in a control unit. Such a remote control unit can also monitor fluid pressure and provide an electrical power source. The spray gun itself can be a manual, hand-held gun or an automatic, robotic gun, which is mounted to a remotely controlled positioning apparatus.

The high-voltage generator, which generates up to 120 kilovolts (kV) in some applications, provides a high-voltage, low current electric signal to the electrodes of the gun. This voltage ionizes the air around the electrodes, thereby producing charged air particles. As powder passes through the gun, the ions attach themselves to the powder particles, thereby forming charged powder particles. These charged powder particles travel toward the grounded work piece and coat the work piece. The coated work piece is then heated in a curing oven so that the powder melts and forms a uniform coating on the work piece.

Therefore, the high-voltage generator plays a vital role in the powder coating gun in providing for the efficient deposition of powder on the work pieces. The high-voltage generator typically consists of a transformer followed by a cascade of capacitors and diodes which form a voltage multiplier. The transformer receives an input voltage, for example, zero to ten Volts (V) alternating current (AC), and steps it up to an intermediate level of approximately two to five kilovolts (kV) AC or more. The intermediate level voltage is then provided to the voltage multiplier, where it is stepped up many fold, to a final voltage of approximately 120 kV DC, for example. This final voltage is normally varied as required during the coating process by varying the input voltage to the transformer.

The voltage multiplier consists of several stages of capacitors and diodes which can produce either a positive or negative voltage at the electrodes of the gun depending on the particular application. Typically, the stages of the voltage multiplier are insulated in a potting compound in order to prevent arcing between components.

If the voltage multiplier fails, of course, the powder coating apparatus is rendered inoperable. Previously, this required the operator to shut down operations if a back-up spray gun was not available. Moreover, often times the operator would be required to send the spray gun back to the manufacturer for diagnosis and repair. This is a time consuming and expensive process. In fact, the cost of a repair of the voltage multiplier circuit by the manufacturer can amount to a substantial portion of the price of an entire new spray gun.

This result is unsatisfactory because it requires the operator to maintain additional stock on hand and reduces overall system throughput and efficiency. In particular, in many small to medium sized manufacturing facilities, it is impractical to keep an extra spray gun available in the event of a voltage multiplier failure due to the prohibitive cost of the equipment.

It would therefore be advantageous to provide a voltage multiplier that can be quickly reset in the event of a failure. In particular, it would be advantageous to provide an apparatus which allows the operator to reset the gun and continue with the powder coating process with minimal interruption and distraction. The apparatus should be easy to use and inexpensive to manufacture, and should add minimal bulk and weight to the gun. Preferably, the apparatus can be easily adapted to existing spray systems (i.e., one does not need to modify the panel, etc., to use the apparatus). Moreover, the apparatus should eliminate time-consuming repairs and minimize required repair stock, thereby improving efficiency and throughput for the operator. The present invention provides the above and other advantages.

SUMMARY OF THE INVENTION

In accordance with the present invention, a powder coating gun with a resettable voltage multiplier circuit is provided. The circuit can be quickly and easily reset by the operator in the event of circuit failure. The apparatus eliminates unnecessary repairs and replacements, thereby improving efficiency and throughput for the operator. Moreover, the apparatus can be easily adapted to existing spray systems. Finally, the apparatus is easily and inexpensively manufactured with minimal added weight and bulk.

It has been determined that voltage multiplier failures in powder coating spray guns are often caused by failure of the first capacitor in the voltage multiplier cascade. The first capacitor is connected directly to the transformer section of the high-voltage generator. In accordance with the present invention, a resettable voltage multiplier circuit is provided. One or more backup capacitors of the voltage multiplier are switchably connectable as substitutes for the first (primary) capacitor coupled to the transformer.

The contact between the transformer section and the voltage multiplier cascade may be made, for example, with wires, pins, conductive brushes, conductive plastics, or other known electrical connection means. In one embodiment, the backup capacitor may be coupled to the transformer by simply removing the barrel of the powder coating gun from the handle, rotating the barrel (which houses the multiplier) to a second position, and reconnecting to the handle. By allowing the operator to switch the voltage multiplier from the failed primary capacitor to a backup capacitor, the voltage multiplier is restored to its normal operation and the powder coating gun can continue to be used.

In one embodiment, a spray gun apparatus including voltage multiplier circuitry is supplied by an electrical power source. The apparatus (i.e., the voltage multiplier circuitry barrel) comprises first coupling means for coupling a primary signal path of the multiplier circuitry to the electrical power source when the apparatus is in a first position, and second coupling means for coupling a secondary signal path of the multiplier circuitry to the electrical power source when the apparatus is in a second position. With this configuration, the apparatus is operable in both the first and second positions.

In a more specific embodiment, the spray gun apparatus comprises a handle for supplying an electrical power source, a barrel removably attachable to the handle in first or second positions for receiving electrical power from the handle, and voltage multiplier circuitry disposed within the barrel. A primary signal path is electrically coupled to a first connecting point of the voltage multiplier circuitry, and a secondary signal path electrically coupled to a second connecting point of the voltage multiplier circuitry.

When the barrel is in the first position relative to the handle, the electrical power source is coupled to the first connecting point, and, when the barrel is in the second position relative to the handle, the electrical power source is coupled to the second connecting point. The apparatus is thus operable in both the first and second positions.

Therefore, according to the present invention, an improved voltage multiplier is presented that is durable, long lasting, and economical. In the event of a circuitry failure, the spray gun need not be replaced or opened up to replace the entire voltage multiplier, but instead, the voltage multiplier circuit can be easily and quickly reset and made ready for continued use.

The present invention can be used with spray guns that dispense both dry or wet paint, and has further application to flocking devices, ionizing water purifiers, electrostatic precipitators, and other devices which employ voltage multiplier circuitry.

DETAILED DESCRIPTION OF THE INVENTION

In accordance with the present invention, a powder coating spray gun with a resettable voltage multiplier circuit allows continued operation of the gun in the event of a voltage multiplier circuit failure caused by failure of the primary capacitor in the circuit.

Figures 1, 2:
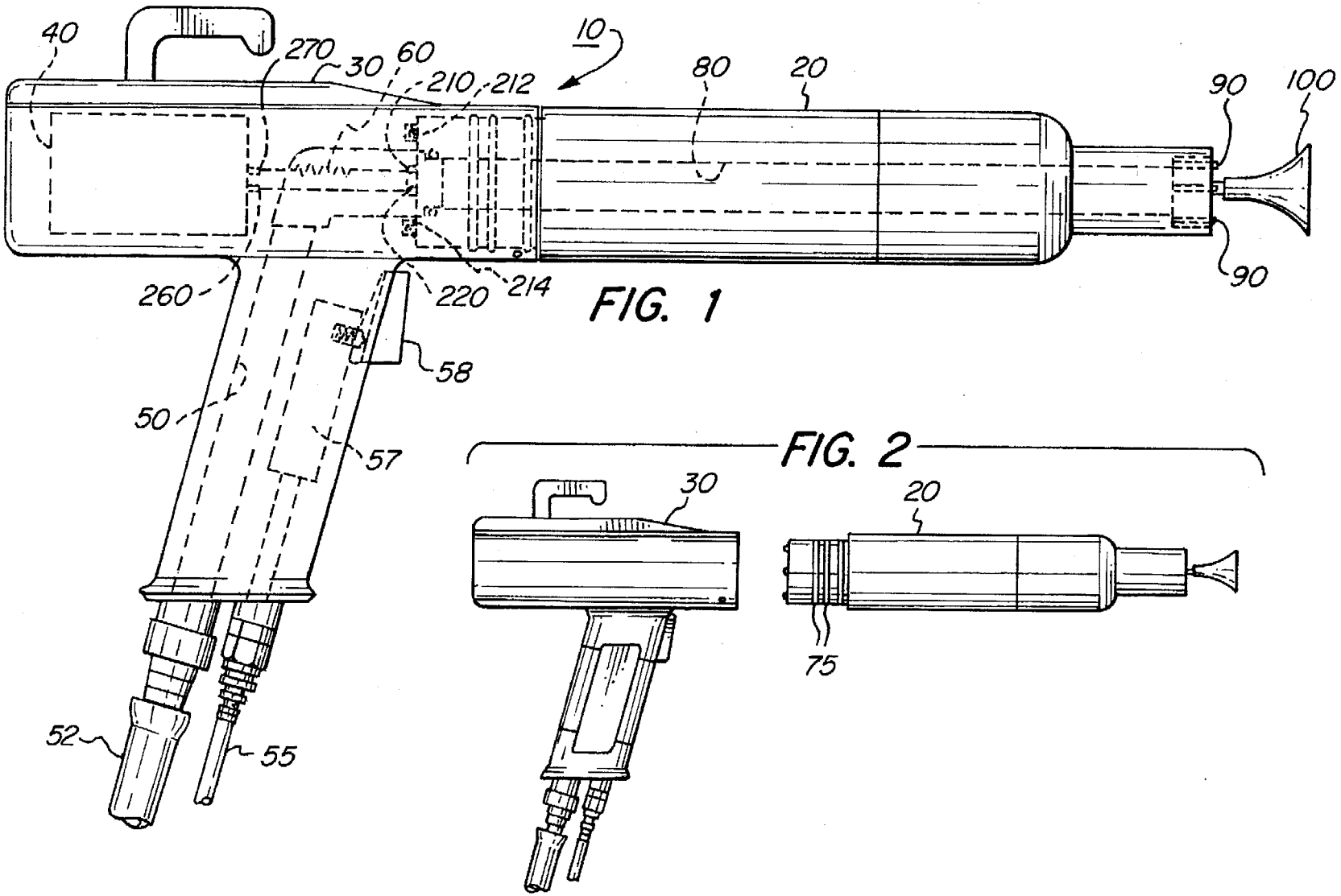
FIG. 1 is a side view of an assembled spray gun with resettable voltage multiplier in accordance with the present invention.
FIG. 2 is a side view of the spray gun of the present invention with the handle and gun barrel in the detached position.

FIG. 1 is a side view of the spray gun with resettable voltage multiplier in accordance with the present invention. The spray gun, shown generally as 10, includes a barrel 20 and a handle 30. The barrel is shown attached to the handle 30 of the gun. In one embodiment, the handle 30 houses a source electric signal supply means such as a transformer 40. The transformer receives an input electric supply signal, for example, zero to ten Volts (V) alternating current (AC), from an electric supply line 55. By activating a trigger 58, the relatively low-voltage electric signal is coupled to supply line and common line inputs of the transformer 40 via switch 57, which provides the low voltage signal to the transformer input through suitable coupling means (not shown).

The transformer, using circuitry well-known to those skilled in the art, receives the low voltage signal and steps it up to an intermediate level of approximately two to five kilovolts (Kv) AC or more. This intermediate electric signal voltage is provided via a high level line 270 and a common line 260 of the transformer 40. The current of the high level line 270 is dropped by a safety resistor 60 and coupled to a socket 210 in the handle 30 of the gun. The common line 260 of the transformer 40 is coupled to a socket 220 in the handle 30 of the gun.

The handle 30 also includes a conduit 50 disposed therein through which powdered paint or the like can pass. The powdered paint is supplied to the conduit 50 via a supply line 52 in a known manner.

The barrel 20 of the spray gun includes a central conduit 80 through which the powdered paint travels after exiting from the conduit 50 of the handle 30. The powdered paint exits the barrel 20 and is deflected by a deflector tip 100 such that a spray pattern is produced as required to coat a work piece. Further details of the construction of the deflector tip and barrel portion of this type of spray gun may be found in U.S. Pat. No. 4,548,363, issued Oct. 22, 1985 to C. McDonough, which is incorporated herein by reference. The exiting powdered paint is electrically charged by positive or negatively charged ions in the vicinity of electrodes 90. A high voltage, low current field is created at the electrodes due to the operation of the voltage multiplier circuitry in the barrel 20 of the gun, as described in greater detail below.

In particular, voltage multiplier circuitry disposed within the barrel 20 is electrically coupled to the high level line 270 and common line 260 of the transformer 40 via electrically conductive sockets 210 and 220, respectively. In one embodiment, the barrel 20 is provided with connecting pins C1A and C2A, or C1B and C2B, which mate with the sockets 210 and 220 of the handle 30. Of course, the voltage multiplier may be coupled to the transformer using a variety of connecting means. For example, wires, pins, conductive brushes, conductive plastics, or other known electrical connection means may be employed. Moreover, the connecting pins may be provided in the handle 30, while sockets are provided in the barrel 20. It is advantageous to avoid protruding electrified elements in the handle 30, however, to reduce the risk of accidental shock. The voltage multiplier circuitry thus receives an electrical power source from the transformer 40 and steps it up many fold to a final voltage of approximately 120 kV DC, for example. This final voltage can be varied as required during the coating process by varying the input voltage to the transformer.

FIG. 2 is a side view of the spray gun of the present invention with the handle 30 and gun barrel 20 in the detached position. O-rings 75 or other known methods may be employed to provide a secure grip between the handle 30 and barrel 20 when the barrel is inserted in the handle. Set screws 216 and 218 (as shown in FIG. 3) may also be used to secure the barrel to the handle when the two portions are mated.

Figures 3, 4A, 4B, 4C:
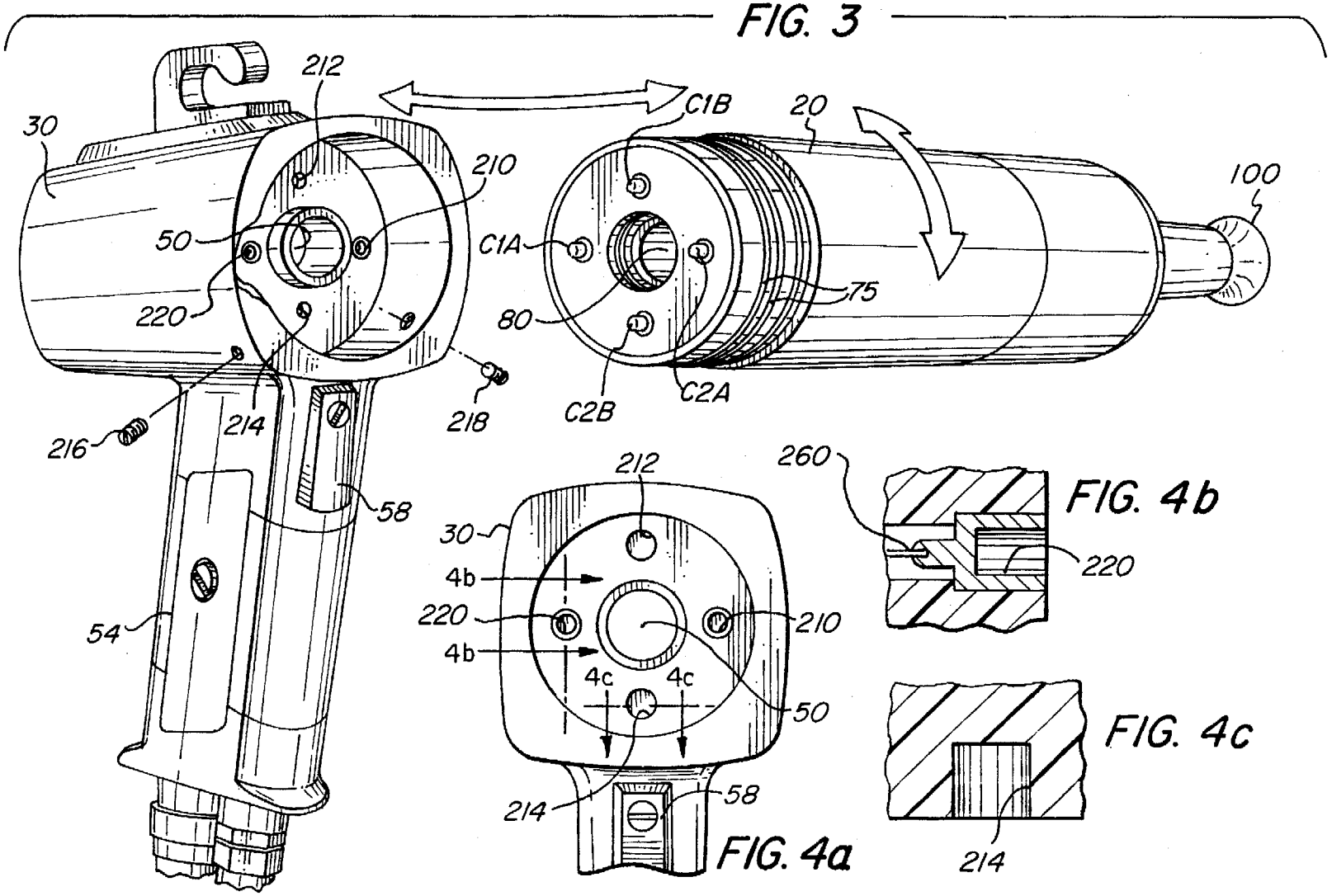
FIG. 3 is a perspective view of the spray gun of the present invention with the handle and gun barrel in the detached position.
FIG. 4*a* is a frontal view of the handle of the spray gun of the present invention showing the active connecting pin sockets and inactive connecting pin openings.
FIG. 4*b* is a cross-sectional view of an active connecting pin socket of the spray gun of the present invention.
FIG. 4*c* is a cross-sectional view of an inactive connecting pin opening of the spray gun of the present invention.

FIG. 3 is a perspective view of the spray gun of the present invention with the handle 30 and gun barrel 20 shown in the detached position. The handle is shown provided with an access panel 54 near the trigger 58 for use in assembling and repairing interior components such as the switch 57. Furthermore, the handle 30 of the gun includes a socket 210 which is coupled to the high level line of the transformer, and a socket 220 which is coupled to the common line of the transformer. Additionally, dummy openings 212 and 214 are provided to accommodate pins C1A and C2A, or alternatively, pins C1B and C2B when the barrel is mated with the handle.

The barrel 20 of the gun includes connecting pins C1A, C1B, C2A and C2B of the voltage multiplier circuit which is disposed within the barrel 20. The barrel 20 houses the voltage multiplier circuitry and includes a central conduit 80 for transport of the powdered paint. Charging electrodes 90 (which are coupled to the output of the voltage multiplier via terminal 234) and a spray pattern deflector 100 are provided at the tip of the gun barrel 20.

To assemble the gun, the barrel 20 is inserted into the handle 30. One or more o-rings 75 are used to provide a friction seal that securely holds the barrel 20 and handle 30 together. Additionally, set screws 216 and 218 may be used to further secure the gun. When the barrel 20 is inserted into the handle 30, the connecting pins C1A, C2A, C1B and C2B of the voltage multiplier circuit are each mated to a respective socket 210, 220 or dummy opening 212, 214 in the handle 30 of the gun.

In one embodiment, the connecting pins are positioned such that the barrel 20 can be inserted into the handle 30 in either of two positions. In a first position, connecting pin C1A is mated to socket 210, while connecting pin C2A is mated to socket 220. At the same time, connecting pins C1B and C2B are mated to dummy openings 212 and 214, respectively.

Accordingly, when the gun barrel 20 is in the first position relative to the handle 30, a first signal path of the voltage multiplier circuit is coupled via terminal C1A and socket 210 to the high level line 270 of the transformer 40, and via terminal C2A and socket 220 to the common line 260 of the transformer 40. In the first position, the spray gun is said to be operating in a "primary mode".

In a second position, connecting pin C1B is mated to socket 210, while connecting pin C2B is mated to socket 220. At the same time, connecting pins C1A and C2A are mated to dummy openings 212 and 214, respectively.

Accordingly, when the gun barrel 20 is in the second position relative to the handle 30, a second signal path of the voltage multiplier circuit is coupled via terminal C1B and socket 210 to the high-voltage supply line 270 of the transformer 40, and via terminal C2B and socket 220 to the common line 260 of the transformer 40. In the second position, the spray gun is said to operating in a "secondary" or "back-up mode".

In another embodiment, only two connecting pins, one socket, and two dummy opening are required to electrically couple the voltage multiplier circuitry in the barrel 20 to the electrical power source in the handle 30. In this embodiment, connecting pins C1A and C1B, socket 210, and dummy openings 212 and 214 are provided. Terminals C2A and C2B (corresponding to the like-numbered connecting pins) of the voltage multiplier are coupled to an electrically conductive ring (not shown) disposed on a portion of the barrel which mates with the handle. Terminal 220 (corresponding to the like-numbered socket) is coupled to an electrically conductive ring (not shown) disposed on a portion of the handle which mates with the barrel.

Accordingly, when the barrel 20 is mated with the handle 30 in a first position, the conducting rings of the barrel 20 and handle 30 are in electrical contact. Therefore, connecting pin C1A is coupled to the high level line 270 via socket 210, terminal C2A is coupled to the common line 260 via the conducting rings and terminal 220, and connecting pin C1B is received by a dummy opening 214 in the handle. The spray gun is then operating in the primary mode.

Similarly, when the barrel is mated with the handle in a second position, connecting pin C1B is coupled to the high level line 270 via socket 210, terminal C2B is coupled to the common line 260 via the conducting rings and terminal 220, and connecting pin C1A is received by a dummy opening 214 in the handle. The spray gun is then operating in the secondary mode.

FIG. 4*a* is a frontal view of the handle 30 of the spray gun of the present invention showing the electrically conductive sockets 210 and 220, the dummy openings 212 and 214, the powder conduit 50, and the trigger 58. In the embodiment shown, the sockets 210 and 220 and openings 212 and 214 are circumferentially and radially equispaced such that the barrel 20 may potentially be attached to the handle 30 in four different positions. However, this is undesirable since the voltage multiplier circuitry requires a high level input at a specific one of the signal paths.

A number of methods may be employed to circumvent the possibility that the barrel 20 is incorrectly attached to the handle 30. For example, the sockets 210 and 220 and openings 212 and 214 may be offset circumferentially or radially such that the connecting pins and sockets/openings can be mated in only the desired primary and secondary positions. Alternately, the barrel 20 and/or handle 30 may be provided with indentations, grooves, flats, or similar constructs (not shown) to ensure that the barrel can be inserted into the handle in only the desired positions. In this manner, the apparatus is made fool-proof so that inadvertent damage or injury does not result. Markings on the barrel 20 and/or handle 30 (e.g., aligned arrows) may also be used to assist the user in properly aligning the two components. Other alternatives will become apparent to those skilled in the art.

FIG. 4*b* is a cross-sectional view of socket 220 of the spray gun of the present invention. Socket 210 has an identical construction. Socket 210 receives either of connecting pins C1A or C1B and electrically couples the connecting pin to the high level line 270 of the transformer 40. Similarly, socket 220 receives either of connecting pins, C2A or C2B, and electrically couples the connecting pin to the common line 260 of the transformer 40.

FIG. 4*c* is a cross-sectional view of either of the dummy opening 214 of the spray gun of the present invention. Opening 212 has an identical construction, and receives either of connecting pins C1B or C2A, while opening 214 receives either of connecting pins C1A or C2B. The openings 212, 214 are not electrically coupled to the transformer, but are simply dummy ports which allow the barrel 20 to be mated with the handle 30 in either the first or second position, as described previously.

Figure 5:
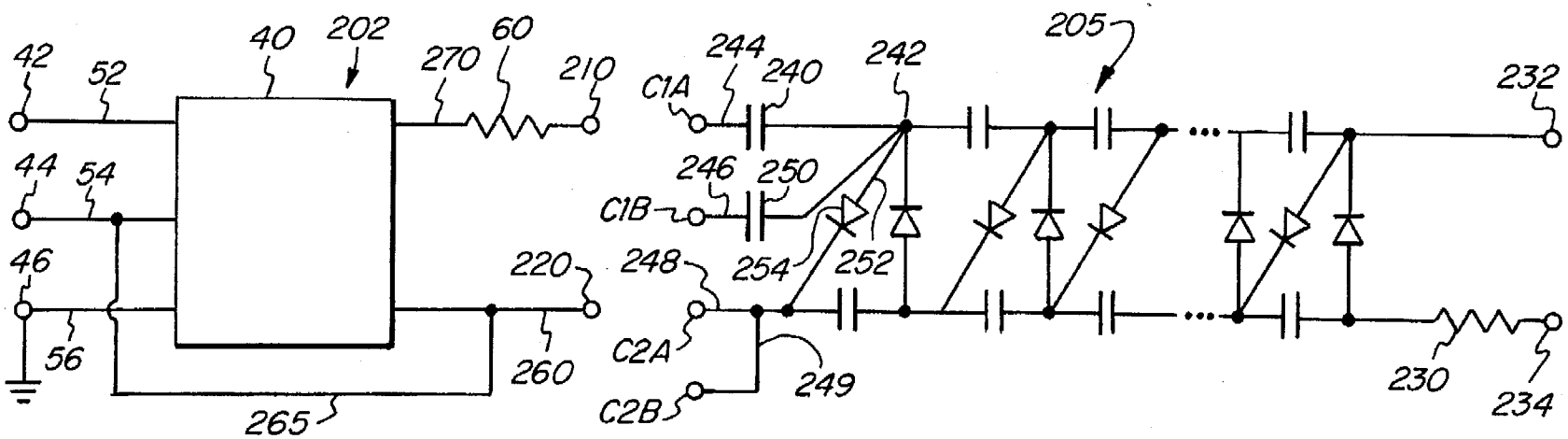
FIG. 5 is a schematic diagram of the resettable voltage multiplier circuitry in accordance with the present invention.

FIG. 5 shows the resettable voltage multiplier circuitry in accordance with the present invention. Typically, the circuitry is housed in the spray gun in order to avoid the need for a stiff, cumbersome high-voltage cable leading from a high voltage source to the gun. The voltage generator circuit includes a transformer section generally designated 202, and a voltage multiplier section generally designated 205. The transformer section 202 receives a low voltage AC current, for example, at zero to ten V, at a line terminal 42 and a common terminal 44. A ground terminal 46 is also provided in a known manner.

A supply line 52 and neutral line 54 couple the low voltage AC current to the transformer 40 of the transformer section 202 of the voltage generator. A connecting line 265 is used to couple common lines 254 and 260. The transformer steps up the input voltage to approximately two to five kV AC. The stepped-up voltage is then applied to the voltage multiplier circuit via a high level line 270 and a common line 260 via terminals 210 and 220, respectively, which correspond to the like-numbered sockets shown in FIGS. 1, 3 and 4*a*. A safety resistance 60 is provided to reduce the output current.

The voltage multiplier circuit 205 portion of the voltage generator employs a cascade of capacitors and diodes which serve to increase the intermediate voltage of two to five kV AC to a final voltage of 120 kV DC, for instance. The diodes allow current to pass in only one direction, in a idealized model. The arrangement of the diodes in the circuit 205 causes the capacitors to continually charge and discharge. The total charge of the multiple stages is an addition of the charge held by each stage. The cascade of diodes and capacitors forms a rectifying circuit, as is well known in the art, thus converting the AC output of the transformer to a high voltage DC output. This high-voltage output is supplied directly to electrodes 90 at the tip of the gun via terminal 234, thereby providing an ionized field for charging the coating powder which is expelled through the tip of the gun and directed toward a work piece.

The voltage multiplier circuit 205 is coupled to the terminals/sockets 210 and 220 of the transformer section 202. In accordance with the present invention, the voltage multiplier 205 comprises a primary capacitor 240 and at least one secondary or backup capacitor 250 which can be alternatively coupled to the high level line 270 of the transformer 40 via socket/terminal 210.

During normal operation, the barrel 20 is in a first position relative to the handle 30 of the gun. Accordingly, the primary capacitor 240 is coupled via line 244 and terminal C1A to socket/terminal 210 of the transformer section 202. Primary capacitor 240 and diode 254 comprise a first stage of the voltage multiplier. Additionally, line 248 of the voltage multiplier is coupled via terminal C2A to the transformer section 202 via socket/terminal 220 and common line 260. Additional stages of the voltage multiplier 205 are provided as indicated. Each stage of the voltage multiplier steps up the voltage from the previous stage such that a high-voltage, low current signal is provided at the electrodes 90 of the spray gun which are coupled to terminal 234. A safety resistor 230 is provided to drop the current at the output terminal 234.

It has been determined that, in many cases, failure of the voltage multiplier is due to failure of the first stage capacitor 240. The capacitor in the stage of the voltage multiplier which is closest to the transformer is most susceptible to failure as this is the capacitor which takes the brunt of a possible line surge which gives a substantially higher voltage than the its rated voltage. The failure of this first capacitor 240 creates an open circuit and renders the further stages electrically passive, which prevents the surge from damaging the further stages.

In the event of a failure of the primary capacitor 240 of the voltage multiplier 205, at least one secondary or back-up capacitor 250 is provided in accordance with the present invention. Both the primary capacitor 240 and secondary capacitor 250 are coupled via a common node 242 of the voltage multiplier circuit. Accordingly, in the event the primary capacitor 240 fails, the voltage multiplier can be made operational by detaching the barrel 20 from the handle 30, rotating the barrel to a second position, and re-attaching the barrel. In the second position, line 244 and terminal C1A are decoupled from socket/terminal 210 of the transformer section 202, and, in their place, secondary capacitor 250 is coupled via line 246 and terminal C1B. Additionally, line 248 and terminal C2A of the voltage multiplier 205 are decoupled from socket/terminal 220 and line 260 of the transformer section 202, and, in their place, line 249 and terminal C2B are coupled. In the embodiment shown, lines 248 and 249 are coupled together, and accordingly, terminals C2A and C2B are at the same potential. The current passing through line 252 and diode 254 will continue to pass through either of line 248 and terminal C2A, or line 249 and terminal C2B.

Heretofore, a failure of the first stage capacitor 240 would render the spray gun inoperable and shut down the user's operations if a second spray gun was not immediately available. Moreover, repair or replacement of the voltage multiplier circuitry is difficult because the circuit components are typically immersed in an insulating potting compound, and, furthermore, many operators lack the technical expertise and equipment to thoroughly diagnose and correct such problems. Similarly, it would be impractical to provide duplicate voltage multiplier circuitry due to size and weight constraints in the spray gun. In particular, for manually operated spray guns, it is important to minimize the weight and bulk of the gun in order to improve comfort and reduce fatigue for the user.

In alternate embodiments, backup circuitry for the first stage diode 254 can be provided. Further, it is possible to account for failures in the second or later stages by providing appropriate backup circuitry. Generally, weight and space limitations in the spray gun will dictate the amount of additional circuitry which can be accommodated.

As can be seen, the present invention provides connecting pins C1A, C2A, C1B, and C2B which selectively couple primary and secondary signal paths of a voltage multiplier circuit 205 to a source electric signal from a transformer 40. When the gun barrel 20 is in a first position relative to the handle 30, the high level output 270 of the transformer is coupled to a primary capacitor 240 in a first signal path through connecting pin C1A of the gun barrel, while the common line 260 is coupled to connecting pin C2A of the gun barrel.

When the gun barrel 20 is in the second position relative to the handle 30, the high level output of the transformer 40 can be coupled to a secondary capacitor in a second signal path through connecting pin C1B of the gun barrel, while the common line 260 of the transformer is connected to connecting pin C2B of the gun barrel. In alternate embodiments of the present invention, additional backup circuitry may be provided with connecting pins, sockets and openings arranged as required.

Therefore, in the event of a failure of the primary capacitor in the voltage multiplier cascade, the operator can quickly and easily switch the voltage multiplier circuitry to a secondary mode by disengaging the gun barrel from the handle, rotating the gun barrel to the second position, and reconnecting the gun barrel to the handle. Markings, detents or the like may be provided on the gun barrel and/or handle in order to allow easy alignment of the gun barrel with the handle and to prevent damage or injury.

In the second position, the connecting pin C1B will be coupled to the high level transformer line 270, while the connecting pin C2B is coupled to the common line 260. Accordingly, the defective primary capacitor 240 is bypassed and the backup capacitor 250 is engaged as part of the voltage multiplier circuitry. Thus, the voltage multiplier circuit 205 of the high-voltage generator of the powder coating gun is returned to normal operation.

It should now be appreciated that the present invention provides a powder coating spray gun with a resettable voltage multiplier. In a preferred embodiment, the gun includes a barrel that is attached to a handle in a first or second position. In the first position, the voltage multiplier circuit operates in a primary mode, while in the second position the voltage multiplier circuit operates in a secondary or back-up mode. The present invention thus provides a powder coating gun that can be easily reset in the event the voltage multiplier fails. The invention allows manufacturers to continue operating while avoiding unnecessary, time consuming and expensive repairs.

Although the invention has been described in connection with a particular embodiment, those skilled in the art will appreciate that numerous modifications and adaptations may be made thereto without departing from the spirit and scope of the invention as set forth in the claims.

Figure 6:
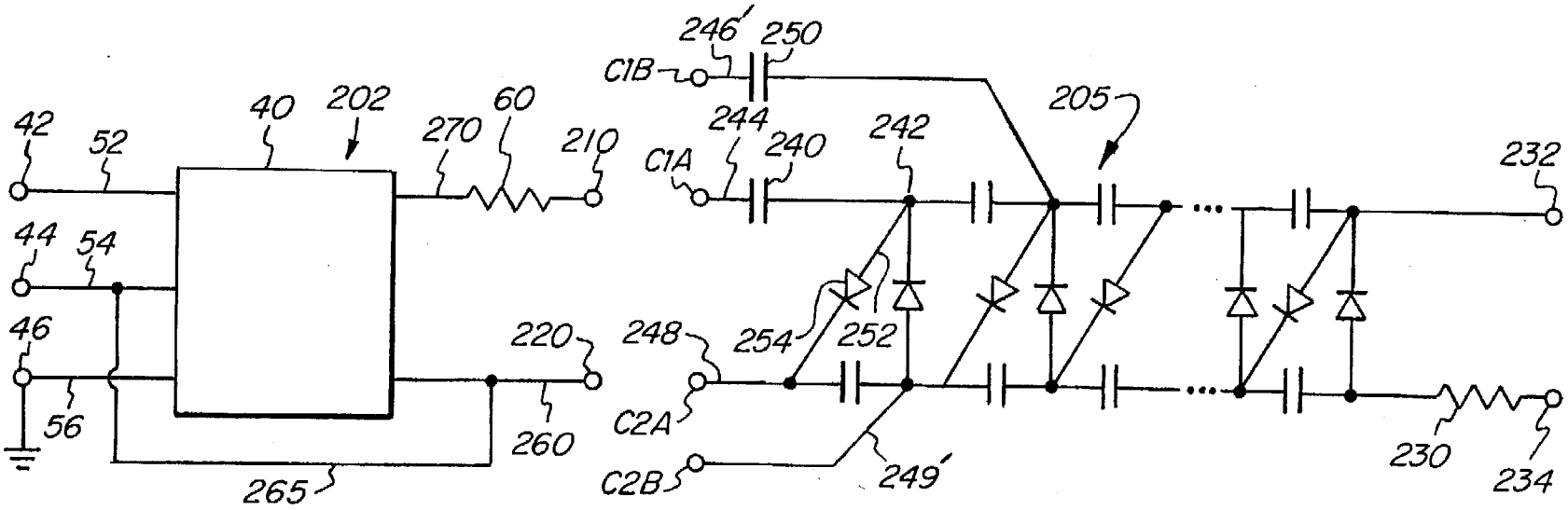
FIG. 6 is a schematic diagram of an alternate embodiment of the resettable voltage multiplier circuitry in accordance with the present invention.

For example, in some cases, a voltage spike can simultaneously damage both the primary and secondary capacitors which are coupled to the first stage of the voltage multiplier 205. This problem can be circumvented by coupling the lines 246' and 249' to the second stage of the voltage multiplier as shown in FIG. 6. In FIG. 6, the reference numerals correspond to like-numbered elements of FIG. 5.

In this embodiment, terminal C1B and the secondary capacitor 250 are coupled via line 246' to the second stage of the voltage multiplier circuit rather than the first stage. Similarly, terminal C2B is coupled via line 249' to the second stage of the voltage multiplier. Thus, when the gun barrel is moved to the second position relative to the handle, the secondary capacitor 250 is coupled to the high level transformer line 270 via terminals C1B and 210, and the line 249' is coupled to the common line 260 of the transformer via terminals C2B and 220. The voltage multiplier circuit is thus returned to operation, although the voltage increase provided by the first stage will no longer be available.

I claim:

1. Spray gun apparatus including voltage multiplier circuitry supplied by an electrical power source, said apparatus comprising:

first coupling means for coupling a primary signal path of said multiplier circuitry to said electrical power source when said apparatus is in a first position;

second coupling means for coupling a secondary signal path of said multiplier circuitry to said electrical power source when said apparatus is in a second position;

said apparatus being operable in both said first and second positions.

2. Apparatus of claim 1 wherein said electrical power source is an alternating current signal.

3. Apparatus of claim 1 wherein said primary signal path and said secondary signal path include a capacitor.

4. Apparatus of claim 1 wherein said electrical power source is provided by a transformer.

5. Spray gun apparatus, comprising:

a handle for supplying an electrical power source;

a barrel removably attachable to said handle in first and second positions for receiving electrical power from said handle; and voltage multiplier circuitry disposed within said barrel, including a primary signal path electrically coupled to a first connecting point of said voltage multiplier circuitry, and a secondary signal path electrically coupled to a second connecting point of said voltage multiplier circuitry;

wherein, when said barrel is in said first position relative to said handle, said electrical power source is coupled to said first connecting point; and when said barrel is in said second position relative to said handle, said electrical power source is coupled to said second connecting point;

wherein said apparatus is operable in both said first and second positions.

6. Apparatus of claim 5 wherein said electrical power source supplies an alternating current to said voltage multiplier circuitry.

7. Apparatus of claim 5 wherein said electrical power source is supplied by a transformer.

8. Apparatus of claim 5 wherein said primary signal path and said secondary signal path include a capacitor.

9. Apparatus of claim 5 wherein, when said barrel is in said first position relative to said handle:

said first connecting point of said voltage multiplier circuitry is a first connecting pin in said barrel which is coupled to the electrical power source via a first socket in said handle; and said second connecting point of said voltage multiplier circuitry is a second connecting pin in said barrel which is received by a first dummy opening in said handle.

10. Apparatus of claim 9 wherein, when said barrel is in said first position relative to said handle:

a third connecting point electrically coupled to said voltage multiplier circuitry is a third connecting pin in said barrel which is coupled to the electrical power source via a second socket in said handle; and a fourth connecting point electrically coupled to said voltage multiplier circuitry is a fourth connecting pin in said barrel which is received by a second dummy opening in said handle.

11. Apparatus of claim 10 wherein, when said barrel is in said second position relative to said handle:

said second connecting pin is coupled to the electrical power source via said first socket; and said first connecting pin is received by said first dummy opening.

12. Apparatus of claim 11, wherein, when said barrel is in said second position relative to said handle:

said fourth connecting pin is coupled to the electrical power source via said second socket; and said third connecting pin is received by said second dummy opening.

13. Apparatus of claim 9 wherein said electrical power source supplies an alternating current to said voltage multiplier circuitry.

14. Apparatus of claim 9 wherein said electrical power source is supplied by a transformer.

15. Apparatus of claim 9 wherein said primary signal path and said secondary signal path include a capacitor.

16. A handle portion of a spray gun apparatus adapted to be removably attachable to a barrel portion of said spray gun, said handle portion comprising:

electrical connectors for coupling with voltage multiplier circuitry of said barrel in first and second positions, and for supplying an electrical signal to said voltage multiplier circuitry; wherein when said barrel is in said first position relative to said handle, said electrical signal is supplied to a primary signal path of said voltage multiplier circuitry; and when said barrel is in said second position relative to said handle, said electrical signal is supplied to a secondary signal path of said voltage multiplier circuitry;

such that said spray gun apparatus is operable in both said first and second positions.

17. The handle of claim 16, wherein said electrical connectors are sockets that mate with connecting pins of said barrel, such that:

when said barrel is in said first position relative to said handle, a first one of said sockets mates with a first one of said connecting pins which is coupled to said primary signal path; and when said barrel is in said second position relative to said handle, a second one of said sockets mates with a second one of said connecting pins which is coupled to said secondary signal path.

18. A barrel portion of a spray gun apparatus adapted to be removably attachable to a handle portion of said spray gun, said barrel portion comprising:

voltage multiplier circuitry;

electrical connectors for coupling with an electrical power source of said handle in first and second positions, and for receiving an electrical signal from said handle; wherein when said barrel is in said first position relative to said handle, said electrical signal is coupled to a primary signal path of said voltage multiplier circuitry; and when said barrel is in said second position relative to said handle, said electrical signal is coupled to a secondary signal path of said voltage multiplier circuitry;

such that said spray gun apparatus is operable in both said first and second positions.

19. The barrel of claim 18, wherein said electrical connectors are connecting pins which mate with sockets in said handle, such that:

when said barrel is in said first position relative to said handle, a first one of said connecting pins which is coupled to said primary signal path mates with a first one of said sockets; and when said barrel is in said second position relative to said handle, a second one of said connecting pins which is coupled to said secondary signal path mates with a second one of said sockets.

20. The barrel of claim 18 wherein said primary signal path and said secondary signal path include a capacitor.

* * * * *